US007161575B2

(12) United States Patent
Ham

(10) Patent No.: US 7,161,575 B2
(45) Date of Patent: Jan. 9, 2007

(54) METHOD AND APPARATUS FOR DRIVING LIQUID CRYSTAL DISPLAY

(75) Inventor: Yong Sung Ham, Kyounggi-do (KR)

(73) Assignee: LG.Philips LCD Co., Ltd., Seoul (KR)

( * ) Notice: Subject to any disclaimer, the term of this patent is extended or adjusted under 35 U.S.C. 154(b) by 39 days.

(21) Appl. No.: 09/994,039

(22) Filed: Nov. 27, 2001

(65) Prior Publication Data

US 2003/0048246 A1 Mar. 13, 2003

(30) Foreign Application Priority Data

Sep. 4, 2001 (KR) ..... 10-2001-0054128

(51) Int. Cl.
*G09G 3/36* (2006.01)
*G09G 5/00* (2006.01)

(52) U.S. Cl. ..... 345/98; 345/89

(58) Field of Classification Search ..... 345/87, 345/89, 94, 95, 97, 96, 98, 100, 101, 99; 749/33

See application file for complete search history.

(56) References Cited

U.S. PATENT DOCUMENTS 4,775,891 A * 10/1988 Aoki et al. ..... 348/572
5,325,372 A 6/1994 Ish-Shalom
5,495,265 A 2/1996 Hartman et al.
5,689,588 A 11/1997 Rombola et al.
6,320,562 B1 * 11/2001 Ueno et al. ..... 345/87
6,473,077 B1 * 10/2002 Takenaka et al. ..... 345/209
6,552,705 B1 * 4/2003 Hirota ..... 345/92
6,633,272 B1 * 10/2003 Kumagawa et al. ..... 345/98

FOREIGN PATENT DOCUMENTS

| | | |
|---|---|---|
| CN | 1279459 A | 1/2001 |
| GB | 2 157 037 A | 10/1985 |
| JP | 63-125910 | 5/1988 |
| JP | 2001-060078 | 3/2001 |
| WO | WO 99/05567 | 2/1999 |

OTHER PUBLICATIONS

Chinese Intellectual Property Office communication dated Feb. 18, 2005.

* cited by examiner

*Primary Examiner*—Dennis-Doon Chow
(74) *Attorney, Agent, or Firm*—McKenna Long & Aldridge LLP

(57) ABSTRACT

The present invention discloses a method and apparatus for driving a liquid crystal display device for enhancing a picture quality. More specifically, in the method and apparatus, source data are modulated based on registered data previously provided. The modulated data derived from the source data are applied to a liquid crystal panel at the initial period of one frame interval. A black voltage as black data is supplied to the liquid crystal panel at least for a portion of the rest of the frame. The black voltage as the black data enables a black picture to be displayed on the liquid crystal panel.

16 Claims, 7 Drawing Sheets

METHOD AND APPARATUS FOR DRIVING LIQUID CRYSTAL DISPLAY

This application claims the benefit of Korean Application No. P2001-54128 filed on Sep. 4, 2001, which is hereby incorporated by reference.

BACKGROUND OF THE INVENTION

1. Field of the Invention

The present invention relates to a liquid crystal display, and more particularly, to a method and apparatus for driving a liquid crystal display. Although the present invention is suitable for a wide scope of applications, it is particularly suitable for enhancing a picture quality.

2. Discussion of the Related Art

Generally, a liquid crystal display (LCD) controls a light transmittance of each liquid crystal cell in accordance with a video signal, thereby displaying a picture. An active matrix LCD including a switching device for each liquid crystal cell is suitable for displaying a dynamic picture. The active matrix LCD uses a thin film transistor (TFT) as a switching device.

The LCD has a disadvantage in that it has a slow response time due to inherent characteristics of a liquid crystal, such as a viscosity and an elasticity, etc. Such characteristics can be explained by using the following equations (1) and (2):

$$\tau_r \propto \gamma d^2/\Delta\epsilon|V_a^2-V_F^2| \quad (1)$$

where $\tau_r$ represents a rising time when a voltage is applied to a liquid crystal, $V_a$ is an applied voltage, $V_F$ represents a Freederick transition voltage at which liquid crystal molecules begin to perform an inclined motion, d is a cell gap of the liquid crystal cells, and $\gamma$ represents a rotational viscosity of the liquid crystal molecules.

$$\tau_f = \gamma d^2/K \quad (2)$$

where $\tau_f$ represents a falling time at which a liquid crystal is returned into the initial position by an elastic restoring force after a voltage applied to the liquid crystal was turned off, and K is an elastic constant.

A twisted nematic (TN) mode liquid crystal has a different response time due to physical characteristics of the liquid crystal and a cell gap, etc. Typically, the TN mode liquid crystal has a rising time of 20 to 80 ms and a falling time of 20 to 30 ms. Since such a liquid crystal has a response time longer than one frame interval (i.e., 16.67 ms in the case of NTSC system) of a moving picture, a voltage charged in the liquid crystal cell is progressed into the next frame prior to arriving at a target voltage. Thus, due to a motion-blurring phenomenon a screen is blurred out at the moving picture.

Referring to FIG. 1, the conventional LCD cannot express desired color and brightness. Upon implementation of a moving picture, a display brightness BL fails to arrive at a target brightness corresponding to a change of the video data VD from one level to another level due to its slow response time. Accordingly, a motion-blurring phenomenon appears from the moving picture and a display quality is deteriorated in the LCD due to a reduction in a contrast ratio.

In order to overcome such a slow response time of the LCD, U.S. Pat. No. 5,495,265 and PCT International Publication No. WO99/05567 have suggested to modulate data in accordance with a difference in the data by using a look-up table (hereinafter referred to as high-speed driving strategy). This high-speed driving method allows data to be modulated by a principle as shown in FIG. 2.

Referring to FIG. 2, a conventional high-speed driving method modulates input data VD and applies the modulated data MVD to the liquid crystal cell, thereby obtaining a desired brightness MBL. This high-speed driving method increases $|V_a^2-V_F^2|$ from the above equation (1) on the basis of a difference of the data so that a desired brightness can be obtained in response to a brightness value of the input data within one frame interval, thereby rapidly reducing a response time of the liquid crystal. Accordingly, the LCD employing such a high-speed driving method compensates for a slow response time of the liquid crystal by modulating a data value in order to alleviate a motion-blurring phenomenon in a moving picture, thereby displaying a picture at desired color and brightness.

In other words, the high-speed driving method compares most significant bit data of a current frame Fn with most significant bit data of the previous frame Fn-1. If the variation in the most significant bit data MSB is detected, a modulated data corresponding to the variation is selected from a look-up table, thereby modulating the source data (or input data) into the modulated data as shown in FIG. 3. The high-speed driving method modulates only a part of the most significant bits among the input data for reducing a memory capacity.

Referring to FIG. 4, a conventional high-speed driving apparatus includes a frame memory 43 connected to a most significant bit output bus line 42 and a look-up table 44 connected to the most significant bit output bus line 42 and the frame memory 43.

The frame memory 43 stores most significant bit data MSB during one frame period and supplies the stored data to the look-up up table 44. Herein, the most significant bit data MSB are higher order 4 bits among 8 bits of the source data RGB.

The look-up table 44 makes a mapping of the most significant bit data of the current frame Fn inputted from the most significant bit output bus line 42 and the most significant bit data of the previous frame Fn-1 inputted from the frame memory 43 into a modulation data table such as Table 1 to select modulated most significant data Mdata. Such modulated most significant bit data Mdata are added to a non-modulated least significant bit data LSB from a least significant bit output bus line 41 before outputting to a liquid crystal display.

TABLE 1

| | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| 0 | 0 | 2 | 3 | 4 | 5 | 6 | 7 | 9 | 10 | 12 | 13 | 14 | 15 | 15 | 15 | 15 |
| 1 | 0 | 1 | 3 | 4 | 5 | 6 | 7 | 8 | 10 | 12 | 13 | 14 | 15 | 15 | 15 | 15 |
| 2 | 0 | 0 | 2 | 4 | 5 | 6 | 7 | 8 | 10 | 12 | 13 | 14 | 15 | 15 | 15 | 15 |
| 3 | 0 | 0 | 1 | 3 | 5 | 6 | 7 | 8 | 10 | 11 | 13 | 14 | 15 | 15 | 15 | 15 |
| 4 | 0 | 0 | 1 | 3 | 4 | 6 | 7 | 8 | 9 | 11 | 12 | 13 | 14 | 15 | 15 | 15 |
| 5 | 0 | 0 | 1 | 2 | 3 | 5 | 7 | 8 | 9 | 11 | 12 | 13 | 14 | 15 | 15 | 15 |

TABLE 1-continued

| | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| 6 | 0 | 0 | 1 | 2 | 3 | 4 | 6 | 8 | 9 | 10 | 12 | 13 | 14 | 15 | 15 | 15 |
| 7 | 0 | 0 | 1 | 2 | 3 | 4 | 5 | 7 | 9 | 10 | 11 | 13 | 14 | 15 | 15 | 15 |
| 8 | 0 | 0 | 1 | 2 | 3 | 4 | 5 | 6 | 8 | 10 | 11 | 12 | 14 | 15 | 15 | 15 |
| 9 | 0 | 0 | 1 | 2 | 3 | 4 | 5 | 6 | 7 | 9 | 11 | 12 | 13 | 14 | 15 | 15 |
| 10 | 0 | 0 | 1 | 2 | 3 | 4 | 5 | 6 | 7 | 8 | 10 | 12 | 13 | 14 | 15 | 15 |
| 11 | 0 | 0 | 1 | 2 | 3 | 4 | 5 | 6 | 7 | 8 | 9 | 11 | 13 | 14 | 15 | 15 |
| 12 | 0 | 0 | 1 | 2 | 3 | 4 | 5 | 6 | 7 | 8 | 9 | 10 | 12 | 14 | 15 | 15 |
| 13 | 0 | 0 | 1 | 2 | 3 | 3 | 4 | 5 | 6 | 7 | 8 | 10 | 11 | 13 | 15 | 15 |
| 14 | 0 | 0 | 1 | 2 | 3 | 3 | 4 | 5 | 6 | 7 | 8 | 9 | 11 | 12 | 14 | 15 |
| 15 | 0 | 0 | 0 | 1 | 2 | 3 | 3 | 4 | 5 | 6 | 7 | 8 | 9 | 11 | 13 | 15 |

In the above Table 1, a left column is for a data voltage VDn-1 of the previous frame Fn-1 while an uppermost row is for a data voltage VDn of the current frame Fn.

Such a conventional high-speed driving method enhances a dynamic contrast ratio in comparison with a conventional normal driving method that does not modulate the source data. However, the conventional high-speed driving method gradually enhances brightness so that a desired brightness level is achieved at the end of one frame interval. Due to this, the conventional high-speed driving method cannot provide a desired picture quality. In other words, due to a data maintaining characteristic of the liquid crystal display device in the conventional high-speed driving method, a dynamic contrast ratio cannot be reached at a desired level. Furthermore, colors represented by combining red, green, and blue are distorted due to the data maintaining characteristic of liquid crystal display device.

SUMMARY OF THE INVENTION

Accordingly, the present invention is directed to a method and apparatus for driving a liquid crystal display that substantially obviates one or more of problems due to limitations and disadvantages of the related art.

Another object of the present invention is to provide a method and apparatus for driving a liquid crystal display enhancing a picture quality.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a method for driving a liquid crystal display includes modulating source data using registered data previously provided and supplying the modulated source data to a display panel at an initial period of one frame interval, and applying a black voltage as black data to the display panel for at least a portion of the rest period of the frame, the black voltage allowing a black picture to be displayed on the display panel.

The method further includes applying the source data to the display panel in such a manner that the source data is positioned between the modulated data and the black data. In this case, the display panel sequentially receives the modulated data, the source data, and the black data. The source data is delayed while applying the modulated data and the black data to the display panel.

In another aspect of the present invention, an apparatus for driving a liquid crystal display includes a modulator modulating source data using registered data previously provided and supplying the modulated source data to a display panel at an initial period of one frame interval, and a black voltage generator generating a black voltage as black data to apply to the display panel for at least a portion of the rest period of the one frame interval, the black voltage allowing a black picture to be displayed on the display panel.

The apparatus further includes a source data provider applying the source data to the display panel in such a manner that the source data is positioned between the modulated data and the black data.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention.

In the drawings.

DETAILED DESCRIPTION OF THE ILLUSTRATED EMBODIMENTS

Reference will now be made in detail to the illustrated embodiments of the present invention, examples of which are illustrated in the accompanying drawings. Wherever possible, the same reference numbers will be used throughout the drawings to refer to the same or like parts.

Figure 1:
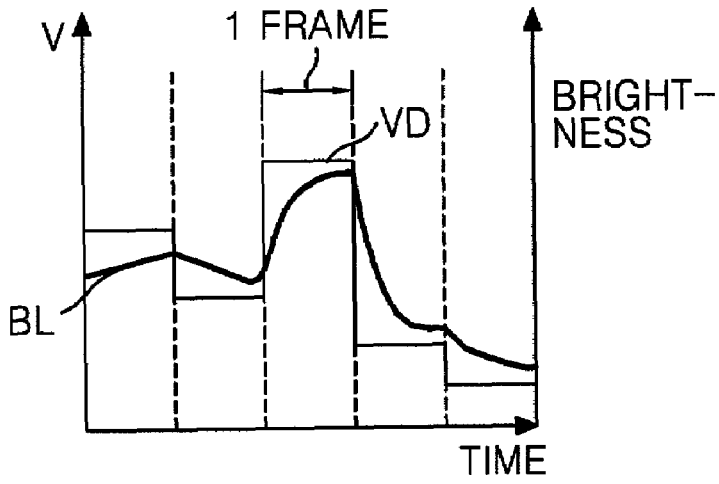
FIG. 1 CONVENTIONAL ART
FIG. 1 is a waveform diagram showing a brightness variation with respect to an applied voltage according to a conventional liquid crystal display.
Figure 2:
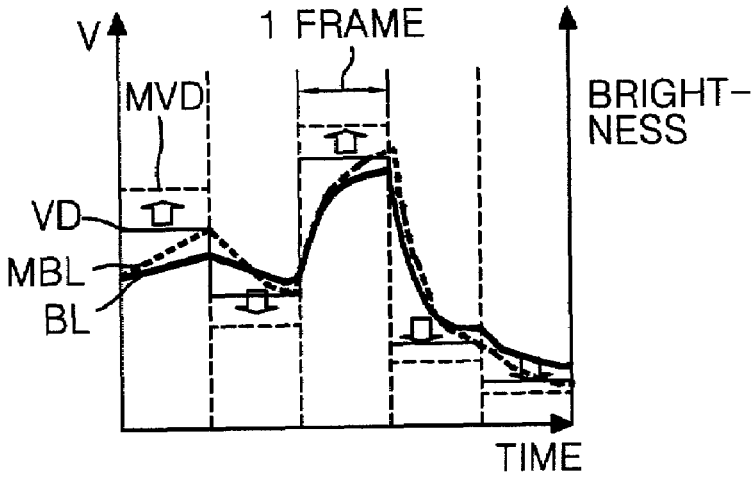
FIG. 2 CONVENTIONAL ART
FIG. 2 is a waveform diagram showing a brightness variation with respect to an applied voltage according to a conventional high-speed driving method.
Figure 3:
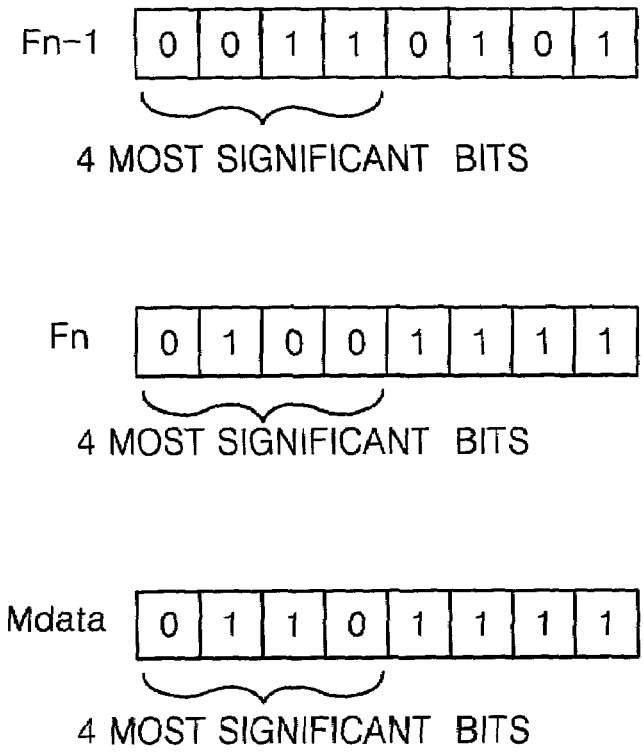
FIG. 3 CONVENTIONAL ART
FIG. 3 illustrates a modulation of most significant bit data in the conventional high-speed driving apparatus for 8 bits of data.
Figure 4:
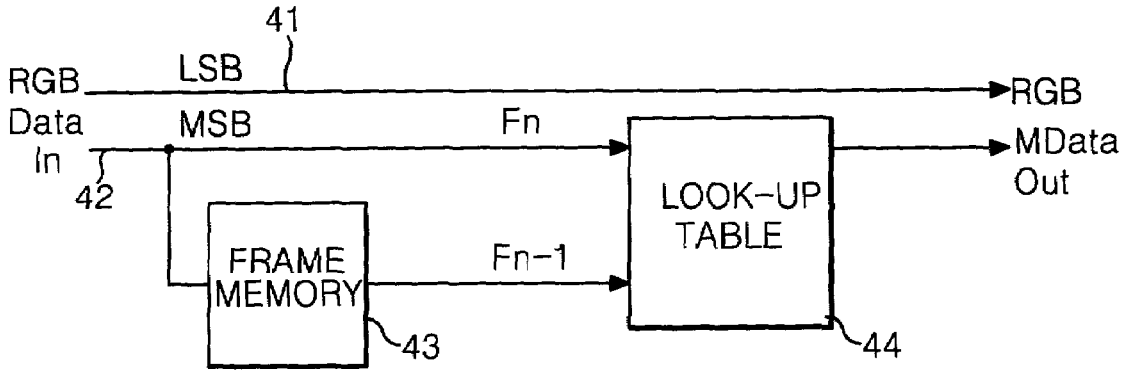
FIG. 4 CONVENTIONAL ART
FIG. 4 is a block diagram showing a configuration of a conventional high-speed driving apparatus.
Figure 5:
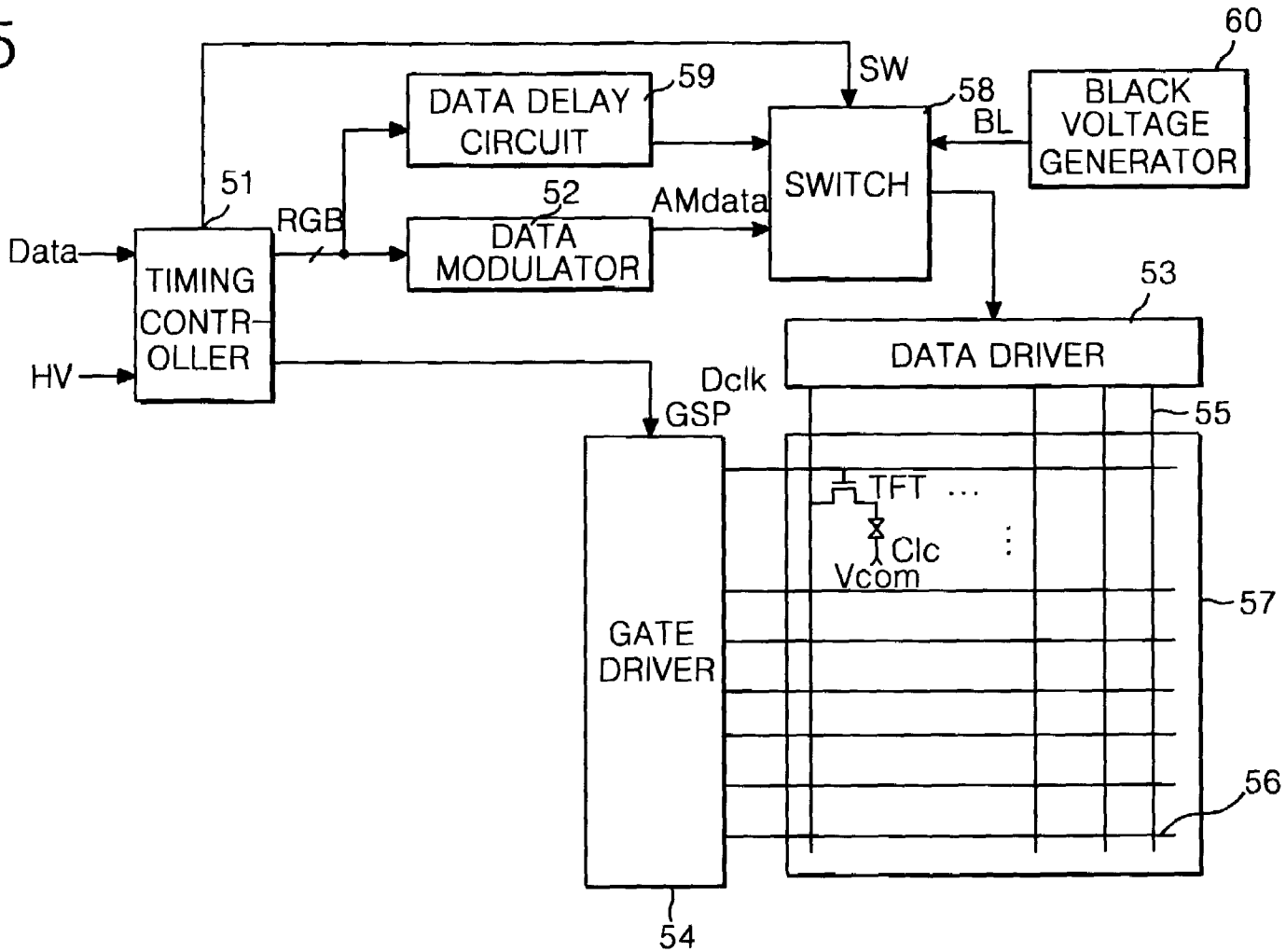
FIG. 5 is a block diagram showing a configuration of a driving apparatus for a liquid crystal display according to a first embodiment of the present invention.

An apparatus for driving a liquid crystal display (LCD) according to a first embodiment of the present invention is shown in FIG. 5.

The LCD driving apparatus includes a liquid crystal display panel 57 having a plurality of data lines 55 and a plurality of gate lines 56 crossing each other and having TFT's provided at the intersections therebetween to drive liquid crystal cells Clc. A data driver 53 supplies data to the data lines 55. A gate driver 54 applies a scanning pulse to the gate lines 56. A timing controller 51 receives digital video data and horizontal and vertical synchronizing signals H and V. A data modulator 52 is connected between the timing controller 51 and the data driver 53 to modulate input data RGB. The LCD driving apparatus further includes a black voltage generator 60generating black data BL, a switch 58 connected between the data modulator 52, the black voltage generator 60 and the data driver 53 to select any one of the black data, modulated data AMdata and normal data, and a data delay circuit 59 connected between the timing controller 51 and the switch 58. The normal data are data which are not modulated.

The liquid crystal display panel 57 has a liquid crystal formed between two glass substrates, and has the data lines 55 and the gate lines 56 provided on the lower glass substrate in such a manner to perpendicularly cross each other. The TFT's provided at each intersection between the data lines 55 and the gate lines 56 respond to a scanning pulse to apply data on the data lines 55 to the liquid crystal cells Clc. To this end, gate electrodes of the TFT's are connected to the gate lines 56 while source electrodes are connected to the data lines 55. The drain electrodes of the TFT's are connected to pixel electrodes of the liquid crystal cells Clc.

The timing controller 51 rearranges digital video data supplied from a digital video card (not shown). The RGB data rearranged by the timing controller 51 are supplied to the data modulator 52 and the data delay circuit 59. Further, the timing controller 51 creates timing control signals, such as a dot clock Dclk, a gate start pulse GSP, a gate shift clock GSC (not shown), an output enable/disable signal, and a polarity control signal using horizontal and vertical synchronizing signals H and V to control the data driver 53 and the gate driver 54. The dot clock Dclk and the polarity control signal are applied to the data driver 53 while the gate start pulse GSP and the gate shift clock GSC are applied to the gate driver 54. Herein, the timing control signals and the polarity control signal generated in the timing controller 51 have frequencies three times greater than those of the conventional timing control signals and a prior polarity control signal. The timing controller 51 also provides a switching control signal SW allowing the switch 58 to switch three times within one frame interval. To this end, the switching control signal SW varies to have a different logical value within one frame interval. In detail, the logical value of the switching control signal SW varies at each ⅓ period unlike the conventional vertical synchronous signal V. The switching control signal consists of at least two bit data so that the switch 58 selects any one of at least three signals such as modulated data Mdata, normal data RGB, black data BL, and so on.

The gate driver 54 includes a shift register sequentially generating a scanning pulse, that is, a gate high pulse in response to the gate start pulse GSP and the gate shift clock GSC applied from the timing controller 51, and a level shifter shifting a voltage of the scanning pulse into a level suitable for driving the liquid crystal cell Clc. The TFT is turned on in response to the scanning pulse to apply video data to the data line 55 to the pixel electrode of the liquid crystal cell Clc. Each gate start pulse GSP and gate shift clock GSC has a frequency three times greater than that of the conventional gate start pulse and the gate shift clock and allows all scanning lines 56 on the liquid crystal display panel 57 to be scanned three times within one frame interval.

The data driver 53 is sequentially supplied with the modulated data AMdata, the normal data RGB and the black data BL from the switch 58 within one frame interval, as well as a dot clock Dclk from the timing controller 51. The data driver 53 continuously selects each of the modulated data Mdata, the normal data RGB and the black data BL in synchronization with the dot clock Dclk and then latches the selected data by one line. The latched data for one line by the data driver 53 is converted into analog data and applied to the data lines 55 in each scanning period. Further, the data driver 53 may apply a gamma voltage corresponding to the modulated data to the data line 55. The dot clock Dclk has a frequency three times greater than that of the conventional dot clock, so that each of the modulated data Mdata, the normal data RGB and the black data BL is applied to each liquid crystal cell Clc within one frame interval.

Figure 6:
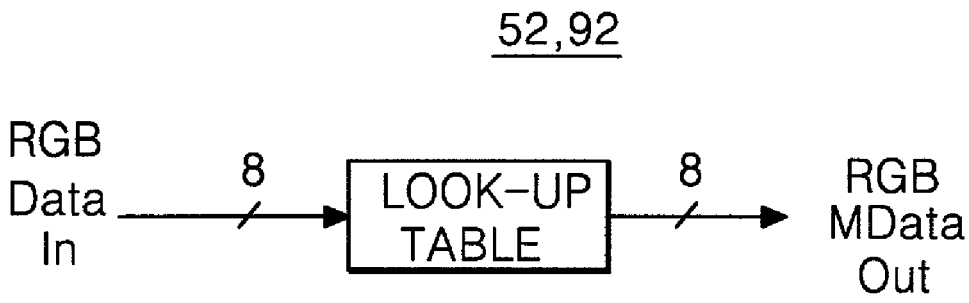
FIG. 6 is a block diagram showing an embodiment of the data modulator shown in FIG. 5.
Figure 7:
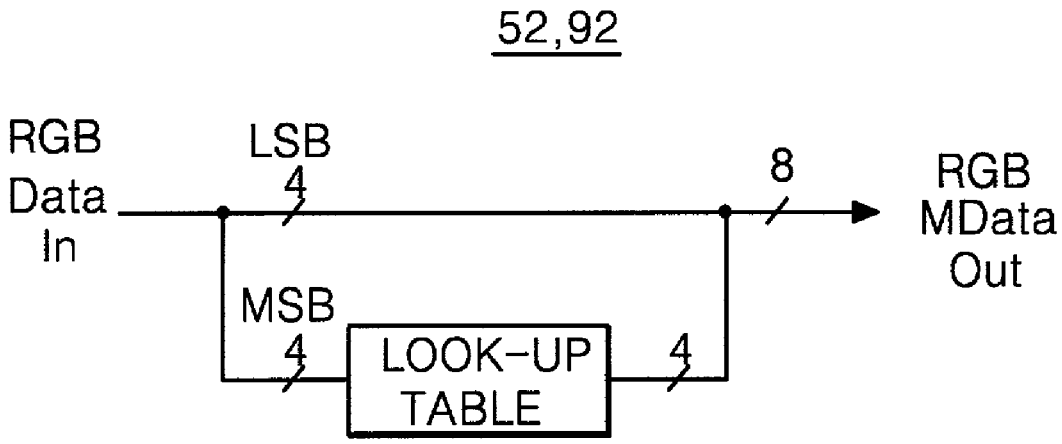
FIG. 7 is a block diagram showing depicts another embodiment of the data modulator shown in FIG. 5.

The data modulator 52 includes a look-up table, as shown in FIGS. 6 and 7,described with the modulated data AMdata opposing to each gray scale value of the normal data RGB. The data modulator 52 modulates the normal data RGB into the modulated data AMdata on the look-up table. The data modulator 52 modulates 8 bits of the source data into 8 bits of the modulated data, as shown in FIG. 6. Alternatively, the data modulator 52 modulates only 4 most significant bits MSB among the 8 bits of the source data into 4 bits of the modulated data in order to reduce a capacity of a memory which is used for the look-up table, as shown in FIG. 7.

The black voltage generator 60 (shown in FIG. 5) generates black data having a voltage which enables the liquid crystal panel 57 to entirely shield light emitted from the back light unit (not shown) to display in black. The black data BL is applied to the switch 58.

In case of modulating the most significant bit data MSB having 4 bits, the modulated data on the look-up table can be mapped as the following Table 2.

TABLE 2

| Source data | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| Modulated data | 0 | 2 | 3 | 5 | 6 | 8 | 9 | 10 | 11 | 12 | 13 | 14 | 15 | 15 | 15 | 15 |

In the above Table 2, each modulated data is determined to have a gray scale level voltage higher than that of the respective source data (the normal data) except for the lowest and highest gray scale level voltage of the data.

The liquid crystal display driving apparatus of the present invention may not require a frame memory because a comparison of the data between the frames is not necessary. Furthermore, since the modulated data to be stored is determined to oppose to each gray scale level of the normal data RGB input as the source data, the liquid crystal display driving apparatus of the present invention reduces a capacity of a memory used for the look-up table, as shown in Table 2.

The switch 58 responds to the switching control signal SW from the timing controller 51 and sequentially applies the modulated data AMdata, the normal data RGB and the black data BL to the data driver 53 within one frame period.

The data delay circuit 59delays the normal data RGB while the modulated data AMdata and the black data BL are applied to the data driver 53.

Figure 8A:
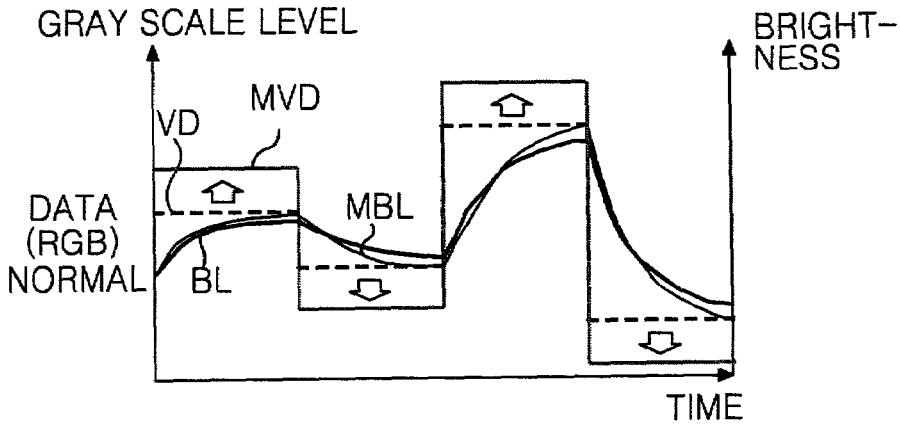
FIGS. 8A to 8C are graphic diagrams showing modulated data and brightness in the first embodiment of the present invention to compare the conventional normal speed driving method with the present invention.
Figure 8B:
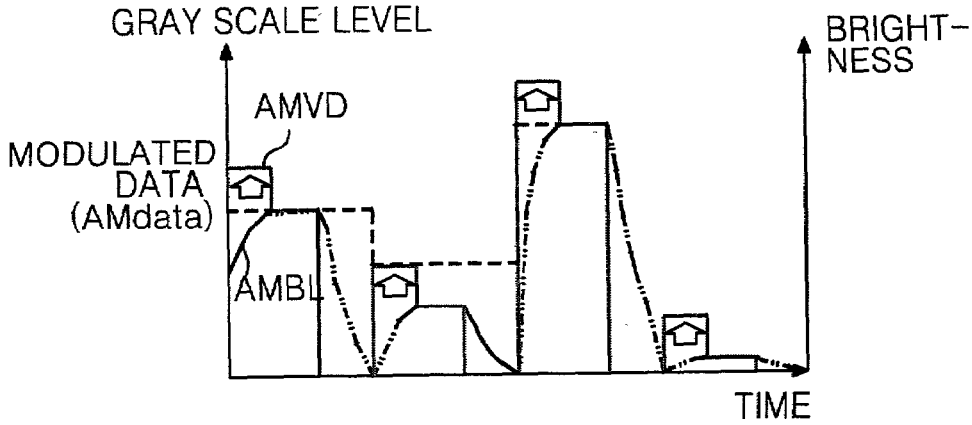
Figure 8C:
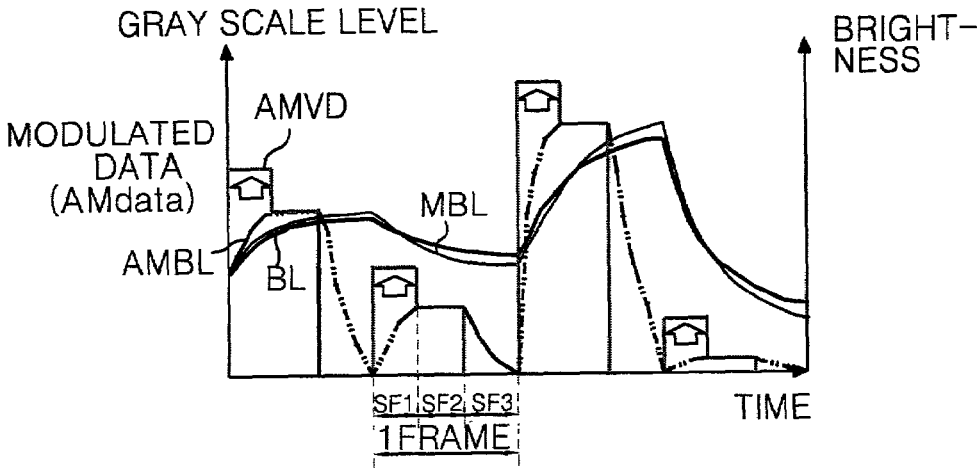

FIGS. 8A to 8C illustrate a variation in brightness with respect to a voltage applied to the liquid crystal panel 57 in the liquid crystal display driving apparatus and method according to the first embodiment of the present invention. As shown in FIG. 8C, one frame interval is divided into a first to third sub-fields SF1 to SF3. The period of each sub-field SF1 to SF3 is appropriately adjusted within one frame interval. For example, the period of each sub-field SF1 to SF3 may be ⅓ of one frame interval.

In FIG. 8A, "VD" is a normal data voltage and "BL" is a brightness varying with the normal data voltage VD. "MVD" is a modulated data voltage modulated by the conventional high-speed driving system and "MBL" is a brightness varying with the modulated data voltage MVD. In FIG. 8B, "AMVD" is a modulated data voltage modulated by the liquid crystal display driving apparatus and method according to the present invention and "AMBL" is a brightness varying with the modulated data voltage AMVD.

In the first sub-field SF1, the modulated data AMdata modulated by the data modulator 52 is applied to the liquid crystal panel 57. The normal data RBG, which is not modulated, is supplied to the liquid crystal panel 57 during sub-field SF2 continued from the first sub-field SF1. The third sub-field SF3 arranged at the end of the frame is used for a pause interval. In the third sub-field SF3, the black data BL is applied to the liquid crystal panel 57. Due to the pause interval of the third sub-field SF3, the data voltage is not required to be maintained as a conventional cathode ray tube, so that a motion blurring does not appear from the moving picture.

Since the modulated data voltage AMVD in the first sub-field SF1 is higher than the normal data voltage VD, an effective voltage applied to the liquid crystal panel 57 of the modulated data voltage AMVD is higher than that of the normal data VD. Accordingly, the brightness of the liquid crystal cell in the primary period of each frame reaches to a desired level. The brightness reached to the desired level is maintained until the second sub-field SF2. The brightness is gradually dropped down to the lowest level by applying the black data voltage within the period of the third sub-field SF3.

As shown in FIGS. 8B and 8C, the liquid crystal display driving apparatus and method according to the present invention allow a data voltage to be shifted always from a black level to a white level or an arbitrary gray scale level of the normal data or the modulated data. To this end, the voltage level of the modulated data AMdata must be determined higher than that of the normal data RGB on the basis of the data modulating argorithm of the high-speed driving method.

Figure 9:
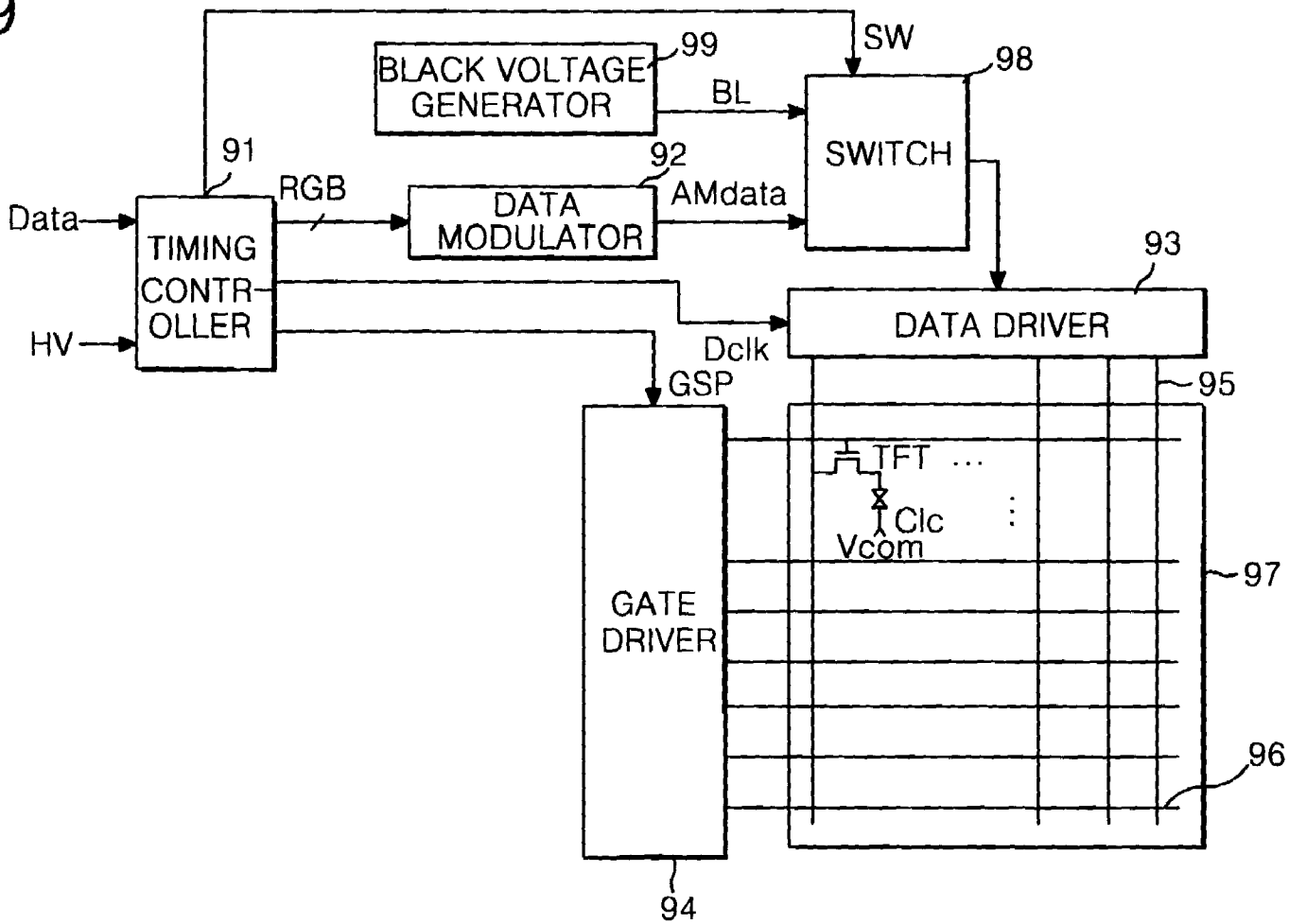
FIG. 9 is a block diagram showing a configuration of a driving apparatus for a liquid crystal display according to a second embodiment of the present invention.

FIG. 9 illustrates a driving apparatus for a liquid crystal display (LCD) according to a second embodiment of the present invention.

The LCD driving apparatus in the second embodiment includes a liquid crystal display panel 97 having a plurality of data lines 95 and a plurality of gate lines 96 crossing each other and having TFT's provided at the intersections therebetween to drive liquid crystal cells Clc. A data driver 93 supplies data to the data lines 95 of the liquid crystal panel 97. A gate driver 94 applies a scanning pulse to the gate lines 96 of the liquid crystal panel 97. A timing controller 91 receives digital video data and synchronizing signals H and V. The LCD driving apparatus of the second embodiment further includes a data modulator 92 connected between the timing controller 91 and the data driver 93 to modulate an input data RGB, a black voltage generator 99 generating a black data BL, and a switch 98 connected between the data modulator 92, the black voltage generator 99 and the data driver 93 to select any one of the black data and the modulated data AMdata.

The liquid crystal panel 97 has the same configuration as the liquid crystal panel 57 of the first embodiment, as shown in FIG. 5.

The timing controller 91 rearranges a digital video data supplied from a digital video card (not shown). The RGB data rearranged by the timing controller 91 is supplied to the data modulator 92.

The timing controller 91 also creates timing control signals, such as a dot clock Dclk, a gate start pulse GSP, a gate shift clock GSC (not shown), an output enable/disable signal, and a polarity control signal using horizontal and vertical synchronizing signals H and V inputted thereto to control the data driver 93 and the gate driver 94. The dot clock Dclk and the polarity control signal are applied to the data driver 93 while the gate start pulse GSP and the gate shift clock GSC are applied to the gate driver 94. Herein, the timing control signals and the polarity control signal generated from the timing controller 91 have frequencies twice greater than those of the conventional timing control signals and a conventional prior polarity control signal, respectively. The timing controller 91 also provides a switching control signal SW allowing the switch 98 to switch the output data twice within one frame interval. To this end, the switching control signal SW is inverted in logical value within one frame interval. In detail, the logical value of the switching control signal SW is inverted at each ½ period unlike the conventional vertical synchronous signal V. The switching control signal consists of only one bit data.

The gate driver 94 includes a shift register sequentially generating a scanning pulse, that is, a gate high pulse in response to the gate start pulse GSP and the gate shift clock GSC applied from the timing controller 91, and a level shifter shifting a voltage of the scanning pulse into a level suitable for driving the liquid crystal cell Clc. The TFT is turned on in response to the scanning pulse to apply video data to the data line 95 to the pixel electrode of the liquid crystal cell Clc. Each gate start pulse GSP and gate shift clock GSC has a frequency twice greater than that of the conventional gate start pulse and the gate shift clock and allows all scanning lines 96 on the liquid crystal panel 97 to be scanned twice within one frame interval.

The data driver 93 is sequentially supplied with the modulated data AMdata and the black data BL from the switch 98 within one frame interval, as well as a dot clock Dclk from the timing controller 91. The data driver 93 continuously selects each of the modulated data AMdata and the black data BL in synchronization with the dot clock Dclk and thereafter latches the selected data by one line. The latched data for one line by the data driver 93 is converted into an analog data and applied to the data lines 95 in each scanning period. Further, the data driver 93 may apply a gamma voltage corresponding to the modulated data to the data line 95. The dot clock Dclk has a frequency three times greater than that of the conventional dot clock, so that each of the modulated data Mdata and the black data BL is applied to each liquid crystal cell Clc within one frame interval.

The data modulator 92 includes a look-up table, as shown in FIGS. 6 and 7,described with the modulated data AMdata opposing to each gray scale value of the normal data RGB and modulates the normal data RGB into the modulated data AMdata on the look-up table. The data modulator 92 modulates 8 bits of the source data into 8 bits of the modulated data, as shown in FIG. 6. Alternatively, the data modulator 92 modulates only 4 most significant bits MSB among the 8 bits of the source data into 4 bits of the modulated data in order to reduce a capacity of a memory which is used for the look-up table, as shown in FIG. 7.

In case of modulating the most significant bit data MSB having 4 bits, the modulated data on the look-up table can be mapped as shown in Table 2.

The black voltage generator 99 generates the black data having a voltage which enables the liquid crystal panel 97 to entirely shield lights from the back light unit (not shown) to display in black. The black data BL is applied to the switch 98.

The switch 98 responds to the switching control signal SW from the timing controller 91 and sequentially applies the modulated data AMdata and the black data BL to the data driver 93 within one frame.

Figure 10A:
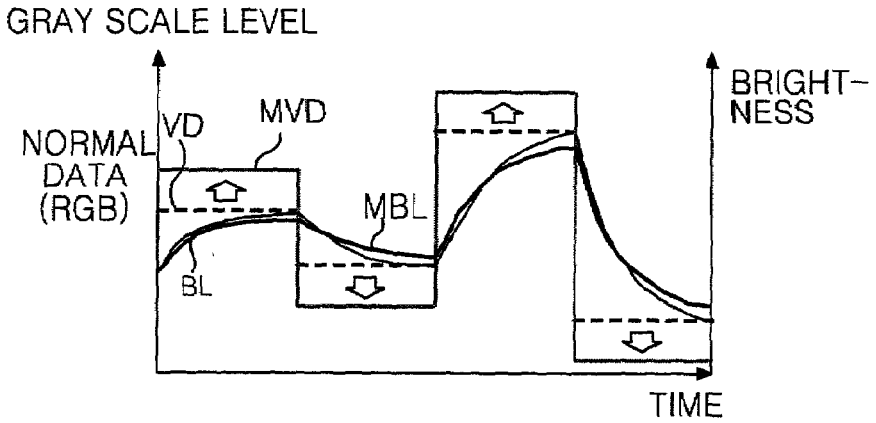
FIGS. 10A to 10C are graphic diagrams showing modulated data and brightness in the second embodiment of the present invention to compare the conventional normal speed driving method with the present invention.
Figure 10B:
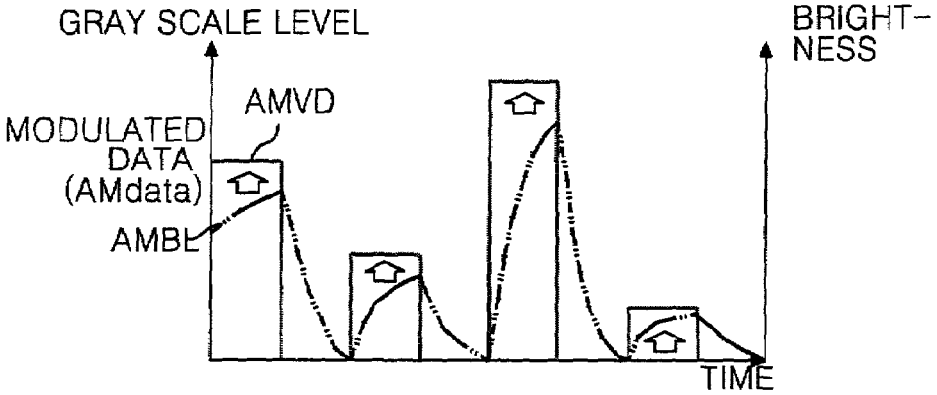
Figure 10C:
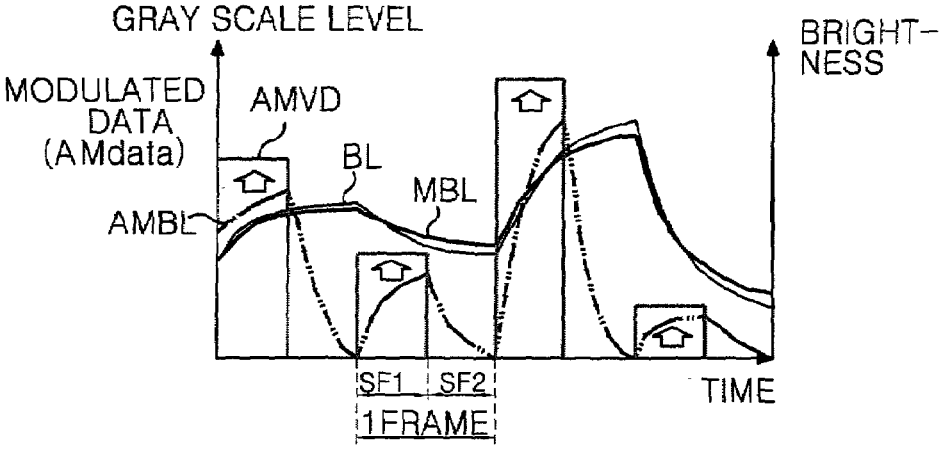

FIGS. 10A to 10C illustrate a variation in brightness with respect to a voltage applied to the liquid crystal panel 97 in the liquid crystal display driving apparatus and method according to the second embodiment of the present invention.

Referring to FIGS. 10B and 10C, one frame interval is divided into a first and second sub-fields SF1 and SF2. The period of each sub-field SF1 and SF2 is appropriately adjusted within one frame interval. For example, the period of each sub-field SF1 and SF2 may be ½ of one frame interval.

In the first sub-field SF1, the modulated data AMdata modulated by the data modulator 92 is applied to the liquid crystal panel 97.

The second sub-field SF2 continued from the first sub-field SF1 is used for a pause interval. In the second sub-field SF2, the black data BL is applied to the liquid crystal panel 97. Due to the second sub-field SF2, a motion blurring does not occur in the moving picture.

As described above, the LCD driving apparatus and method according to the present invention apply the normal data and the black data to the liquid crystal panel after supplying of the modulated data to the liquid crystal panel. Alternatively, the LCD driving apparatus and method according to the present invention can sequentially supply the modulated data and the black data to the liquid crystal panel. Accordingly, the LCD drive apparatus and method allow a motion blurring to be minimized. As a result, the LCD drive apparatus and method provide with a high quality moving picture.

The data modulator may be implemented by other means, such as a program and a microprocessor for carrying out this program, rather than the look-up table. The present invention may be applied to a digital flat display device, which requires the data modulation, such as a plasma display panel, a electro-luminescence display device, an electric field emitting device and so on. Furthermore, the switch, the data delay circuit and the black voltage generator may be combined in one unit together with the timing controller or the data driver.

It will be apparent to those skilled in the art that various modifications and variations can be made in the method and apparatus for driving the liquid crystal display of the present invention without departing from the spirit or scope of the inventions. Thus, it is intended that the present invention covers the modifications and variations of this invention provided they come within the scope of the appended claims and their equivalents.

What is claimed is:

1. A method of driving a liquid crystal display, comprising:

modulating source data and supplying the modulated source data to a display panel during a first period within a frame interval, wherein modulating the source data includes selecting a gray scale voltage level corresponding to the source data;

delaying the source data during the first period and supplying the delayed source data to the display panel during a second period within the frame interval; and applying a black voltage data to the display panel during a third period within the frame interval, the black voltage data corresponding to a black picture to be displayed on the display panel, wherein the first period, the second period, and the third period do not overlap each other.

2. The method according to claim 1, wherein modulating the source data includes selecting a gray scale voltage based on the most significant bits of the source data.

3. The method according to claim 1, wherein modulating the source data includes selecting a gray scale voltage based on all of the bits of the source data.

4. The method according to claim 1, further comprising sequentially switching the modulated source data, the delayed source data, and the black data to apply to the display panel.

5. The method according to claim 1, wherein the third period within the frame interval occurs after the first period and before the second period.

6. An apparatus for driving a liquid crystal display, comprising:

a modulator that modulates source data and supplies the modulated source data to a display panel during a first period within a frame interval, wherein the modulator includes a look-up table;

a delay circuit that delays the source data during the first period and supplies the delayed source data to the display panel during a second period within the frame interval; and a black voltage generator that generates a black voltage data to apply to the display panel during a third period within the frame interval, wherein the black voltage corresponds to a black picture to be displayed on the display panel, wherein the first period, the second period, and the third period do not overlap with each other.

7. The apparatus according to claim 6, further comprising a source data provider that provides the delayed source data to the display panel in such a manner that the source data are provided after the modulated source data and before the black data.

8. The apparatus according to claim 6, wherein the modulator modulates most significant bits of the source data.

9. The apparatus according to claim 6, wherein the modulator modulates all of the bits of the source data.

10. The apparatus according to claim 6, further comprising a switch that sequentially switches the modulated source data, the delayed source data, and the black data to apply to the display panel within the one frame interval.

11. The apparatus according to claim 10, further comprising:

a data driver that applies the modulated source data and the black data from the switch to the display panel;

a scanning driver that applies a scanning signal to the display panel; and a timing controller that applies the source data to the modulator, and controlling the data driver, the scanning driver, and a switching time of the switch.

12. The apparatus according to claim 10, further comprising:

a data driver that applies the modulated source data, the delayed source data, and the black data from the switch to the display panel;

a scanning driver that applies a scanning signal to the display panel; and a timing controller that applies the source data to the modulator and the delay circuit, and controlling the data driver, the scanning driver, and a switching time of the switch.

13. The apparatus according to claim 10, wherein the modulated source data, the delayed source data and the black data are applied at about ⅓, ⅓ and ⅓ of the one frame interval, respectively.

14. The apparatus according to claim 6, wherein the delay circuit delays the source data while the modulated source data and the black data are applied to the display panel.

15. A liquid crystal display comprising:

a liquid crystal display panel;

a data modulator that modulates source data and supplies the modulated source data to the liquid crystal display during a first period within a frame interval, wherein the data modulator selects a gray scale voltage level corresponding to the source data;

a delay circuit that delays the source data during the first period and supplies the delayed source data to the display panel during a second period within the frame interval;

a black voltage generator that generates a black voltage data allowing a black picture on the display panel during a third period within the frame interval;

a switch that switches the modulated source data and the black data;

a data driver that applies the modulated source data and the black data from the switch to the liquid crystal display panel;

a scanning driver that applies scanning signal to the liquid crystal display panel; and a timing controller that applies the source data to the modulator and controls the data driver, the scanning driver, and a switching time of the switch, wherein the first period, the second period, and the third period do not overlap each other.

16. The liquid crystal display according to claim 15, wherein the switch switches among the modulated source data, the delayed source data and the black data, so that the delayed source data are applied after the modulated source data and before the black data within the one frame interval.

* * * * *